US006546900B2

(12) United States Patent
Arai et al.

(10) Patent No.: US 6,546,900 B2
(45) Date of Patent: Apr. 15, 2003

(54) VARIABLE COMPRESSION RATIO MECHANISM FOR RECIPROCATING INTERNAL COMBUSTION ENGINE

(75) Inventors: Takayuki Arai, Yokohama (JP); Katsuya Moteki, Tokyo (JP); Ryosuke Hiyoshi, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/813,891

(22) Filed: Mar. 22, 2001

(65) Prior Publication Data

US 2001/0039929 A1 Nov. 15, 2001

(30) Foreign Application Priority Data

May 9, 2000 (JP) ..... 2000-135436

(51) Int. Cl.[7] ..... F02B 75/04
(52) U.S. Cl. ..... 123/48 B; 123/78 E
(58) Field of Search ..... 123/48 B, 78 E, 123/78 F, 197.4

(56) References Cited

U.S. PATENT DOCUMENTS 4,517,931 A * 5/1985 Nelson ..... 123/48 B
5,595,146 A 1/1997 Bollig et al.

FOREIGN PATENT DOCUMENTS

DE 29 35 073 A1 3/1981
DE 195 04 735 A1 8/1996
EP 0 292 603 A1 11/1988
GB 2 273 327 A 6/1994
JP 9-228858 9/1997 ..... F02D/15/02
JP 2000073804 * 3/2000 ..... F02D/15/02

OTHER PUBLICATIONS

Yoshihiro, Shigeo, Reciprocating Engine, JP 08061932, filed Feb. 24, 1996, European Patent Office *Patent Abstracts of Japan,* vol. 1998, No. 01, Jan. 30, 1998 (published JP 09 228858 A, Sep. 2, 1997).

* cited by examiner

*Primary Examiner*—Noah P. Kamen
(74) *Attorney, Agent, or Firm*—Foley & Lardner

(57) ABSTRACT

A variable compression ratio mechanism for a reciprocating engine includes a connecting rod split into upper and lower connecting rod portions linked to each other through a first connecting pin. A rockable arm is oscillatingly linked at one end to the lower connecting rod portion through a second connecting pin. A control mechanism shifts the center of oscillating motion of the rockable arm to vary a compression ratio of the engine. A piston stroke is set to be greater than two times a crank radius of a crank, irrespective of variations in the compression ratio. A linkage is dimensioned and laid out, so that its crankpin load is less than a crankpin load produced by a linkage that the crankpin is located on a perpendicular line at substantially the midpoint of a line segment between and including the centers of the first and second connecting pins.

13 Claims, 7 Drawing Sheets

6
10b
9
21
α1
α2
S1
S2
D1
D2
S
x
y

VARIABLE COMPRESSION RATIO MECHANISM FOR RECIPROCATING INTERNAL COMBUSTION ENGINE

TECHNICAL FIELD

The present invention relates to the improvements of a variable compression ratio mechanism for a reciprocating internal combustion engine.

BACKGROUND ART

In recent years, there have been proposed and developed various variable compression ratio mechanisms for reciprocating internal combustion engines. One such variable compression ratio mechanism has been disclosed in Japanese Patent Provisional Publication No. 9-228858 (hereinafter is referred to as JP9-228858). JP9-228858 teaches the use of an oscillating or rockable lever (called a bridge) provided between a control arm (called a rocking arm) and a connecting rod, for the purpose of varying the position of top dead center of a piston by oscillating motion of the so-called bridge, thereby varying the compression ratio. In the reciprocating engine with such a variable compression ratio mechanism, the piston stroke is 2 times or more the radius of a crank, in accordance with the principle of lever-and-fulcrum or leverage. In comparison with a radius of a crank of a typical reciprocating internal combustion engine with a piston crank mechanism and of the same engine's displacement, the crank radius of the reciprocating engine with the variable compression ratio mechanism can be reduced or shortened. This enables increased overlap between a crankpin and a crankshaft main-bearing journal, thus enhancing the rigidity of the crank. Therefore, the reciprocating engine with the variable compression ratio mechanism carries the advantage of increasing the mechanical strength of the crank, and of attenuating noise and vibration during operation of the engine.

SUMMARY OF THE INVENTION

However, in the reciprocating engine disclosed in JP9-228858, the crankpin is located on a perpendicular line at substantially the midpoint of the bridge, and additionally the lower end of the connecting rod and the lower end of the rocking arm are rotatably linked respectively to both ends of the bridge by way of a pin-connection. Consider an input force Fp acting on the crankpin, an input force Fp1 acting on a first connecting pin via which the connecting rod and the bridge are linked to each other, and an input force Fp2 acting on a second connecting pin via which the bridge and the rocking arm are linked to each other. Assuming that the moments of the forces Fp1 and Fp2 about the crankpin are balanced and the crankpin is located just at the central portion of the bridge, the magnitude of force Fp1 is equal to the magnitude of force Fp2 (Fp1=Fp2), because the distance between the first connecting pin and the center of the bridge is identical to the distance between the second connecting pin and the center of the bridge. As viewed from equilibrium of forces, the summation (Fp1+Fp2) of the two forces Fp1 and Fp2 acting on the respective connecting pins is equivalent to the force Fp acting on the crankpin, that is, Fp=Fp1+Fp2=2Fp1. In other words, two times input load applied to the piston is input into the crankpin journal portion and/or bearing inserts fitted to the central bore of the bridge. To provide the same resistance and durability against the same bearing pressure, the bearing surface area must be increased or the resistance against bearing pressure must be increased.

There are some demerits, that is, reduced wear resistance, increased production costs, friction loss, and the like.

Accordingly, it is an object of the invention to provide a variable compression ratio mechanism for a reciprocating internal combustion engine, which avoids the aforementioned disadvantages.

It is another object of the invention to provide a variable compression ratio mechanism for a reciprocating internal combustion engine which is capable of balancing two contradictory requirements, that is, increased piston stroke and reduced load applied to a crankpin.

In order to accomplish the aforementioned and other objects of the present invention, a variable compression ratio mechanism for a reciprocating internal combustion engine comprises a connecting rod connecting a crank on a crankshaft with a piston, the connecting rod being split into an upper connecting rod portion oscillatingly linked to the piston through a piston pin and a lower connecting rod portion rotatably linked to a crankpin of the crankshaft, the upper and lower connecting rod portions being oscillatingly linked to each other through a first connecting pin, a rockable arm oscillatingly linked at one end to the lower connecting rod portion through a second connecting pin, a control mechanism shifting a center of oscillating motion of the rockable arm to vary a compression ratio of the engine, the rockable arm being oscillatingly linked at its other end via the control mechanism to a cylinder block, a piston stroke of the piston being set to be greater than two times a crank radius of the crank on the crankshaft, irrespective of whether the compression ratio is varied by the control mechanism, and a linkage having at least the upper and lower connecting rod portions, the first and second connecting pins and the rockable arm being dimensioned and laid out, so that a crankpin load acting on the crankpin is less than a crankpin load produced by a linkage that has the crankpin located on a perpendicular line at substantially a midpoint of a line segment between and including a center of the first connecting pin and a center of the second connecting pin.

According to another aspect of the invention, a variable compression ratio mechanism for a reciprocating internal combustion engine comprises a connecting rod connecting a crank on a crankshaft with a piston, the connecting rod being split into an upper connecting rod portion oscillatingly linked to the piston through a piston pin and a lower connecting rod portion rotatably linked to a crankpin of the crankshaft, the upper and lower connecting rod portions being oscillatingly linked to each other through a first connecting pin, a rockable arm oscillatingly linked at one end to the lower connecting rod portion through a second connecting pin, a compression-ratio control means for shifting a center of oscillating motion of the rockable arm to vary a compression ratio of the engine, the rockable arm being oscillatingly linked at its other end via the compression-ratio control means to a cylinder block, a piston stroke of the piston being set to be greater than two times a crank radius of the crank on the crankshaft, irrespective of whether the compression ratio is varied by the compression-ratio control means, and a linkage having at least the upper and lower connecting rod portions, the first and second connecting pins and the rockable arm being dimensioned and laid out, so that an arm length for a moment of a force acting on the first connecting pin about the crankpin is shortened relatively to an arm length for a moment of a force acting on the second connecting pin about the crankpin.

The other objects and features of this invention will become understood from the following description with reference to the accompanying drawings.

DESCRIPTION OF THE PREFERRED EMBODIMENTS

Figure 1:
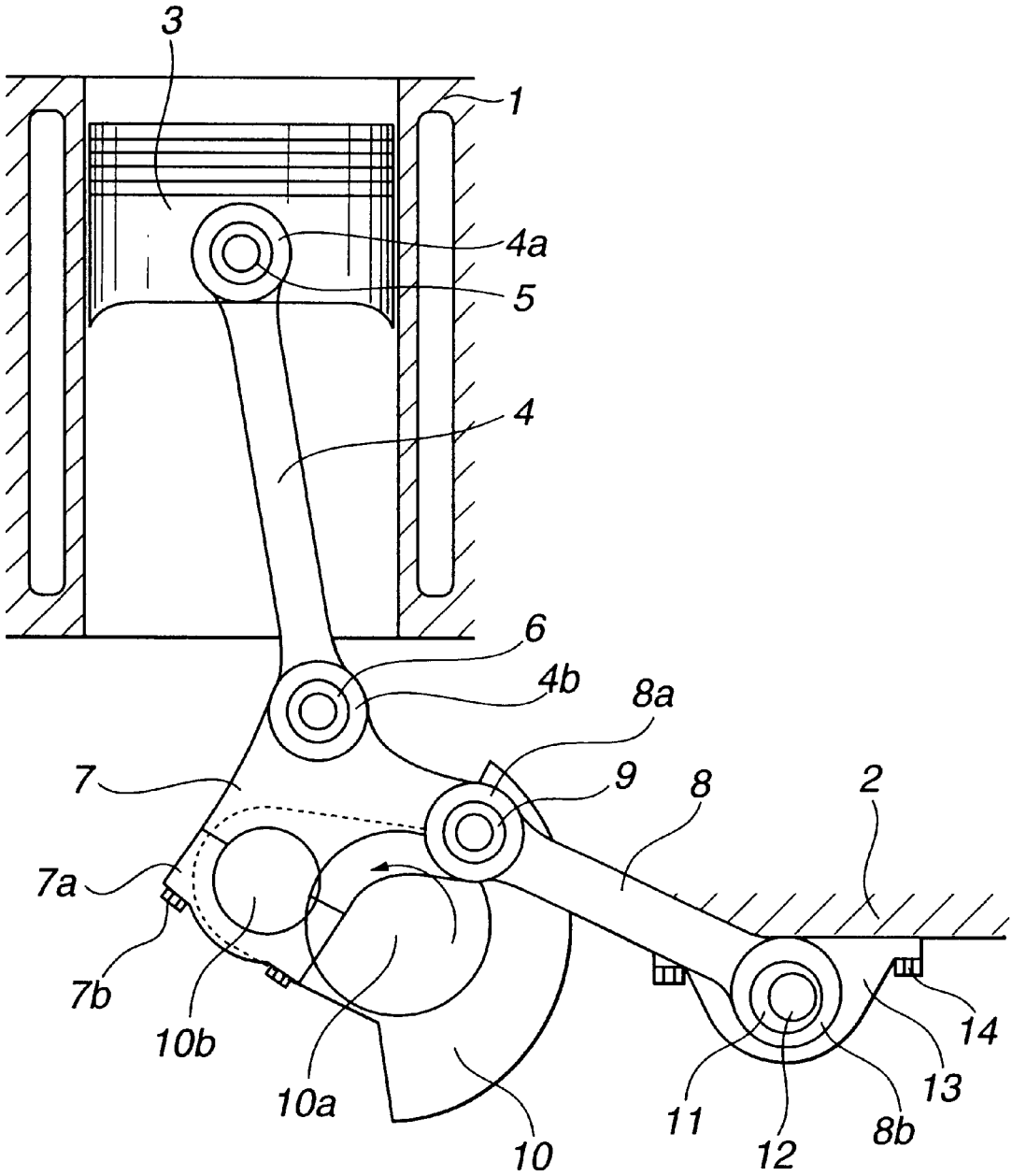
FIG. 1 is an assembled view showing one embodiment of a variable compression ratio mechanism for a reciprocating engine.
Figure 2:
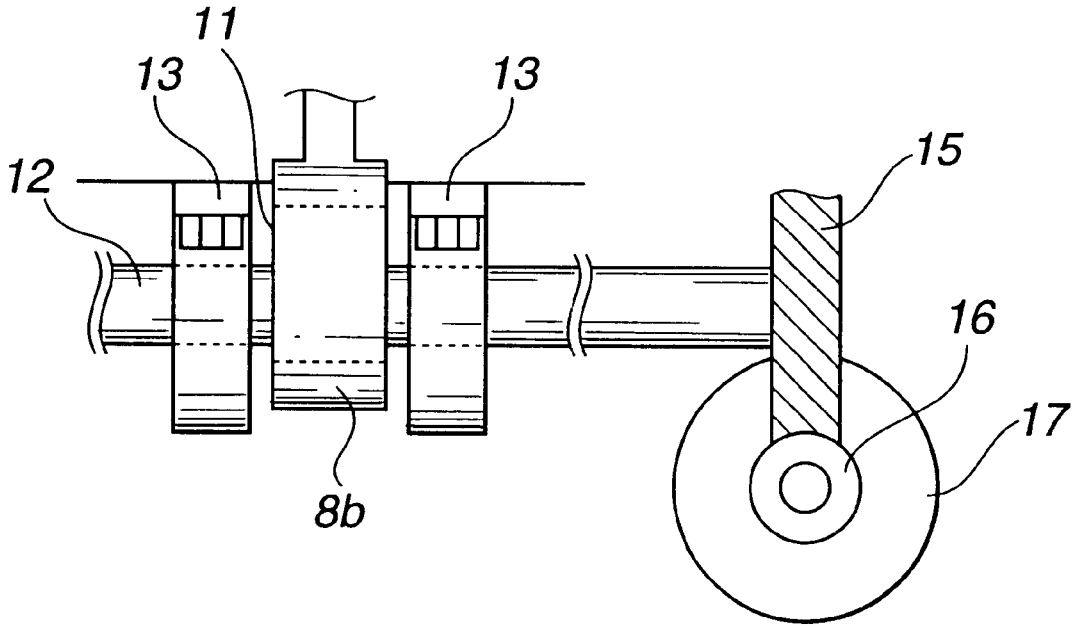
FIG. 2 is a schematic diagram illustrating a compression-ratio control actuator incorporated in the variable compression ratio mechanism of the embodiment.
Figure 3:
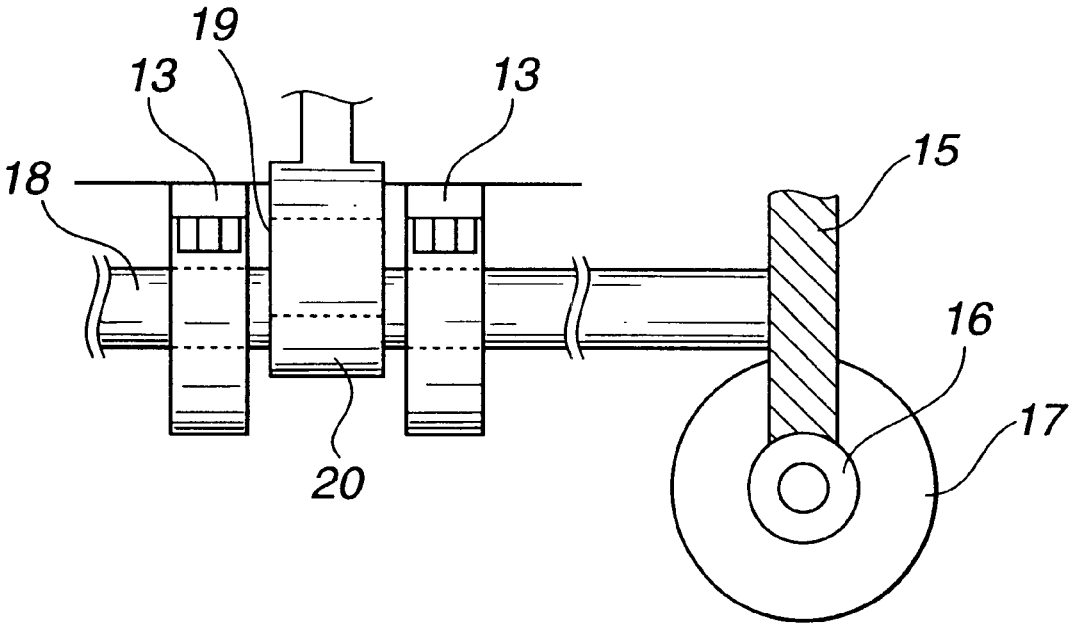
FIG. 3 is a schematic diagram illustrating another type of the compression-ratio control actuator incorporated in the variable compression ratio mechanism of the embodiment.

Referring now to the drawings, particularly to FIG. 1, the variable compression ratio mechanism of the embodiment of a reciprocating internal combustion engine has an upper connecting rod 4 and a lower connecting rod 7. A piston 3 fitted to a cylinder or a cylinder liner 1, is attached to the upper end portion 4*a* of upper connecting rod 4 via a piston pin 5, to permit adequate freedom for movement between the piston and pin. The lower end 4*b* of upper connecting rod 4 is oscillatingly or rockably connected to the lower connecting rod 7 via a connecting pin 6. Lower connecting rod 7 is rotatably connected to a crankpin 10*b* of a crankshaft 10. Lower connecting rod 7 is also rotatably connected to one ring-shaped end 8*a* of a rockable arm 8 via a connecting pin 9. The other ring-shaped end 8*b* of rockable arm 8 is oscillatingly or rockably connected to an eccentric pin 11. Eccentric pin 11 is fixedly connected to one end of a control shaft 12 so that the center of eccentric pin 11 is eccentric with respect to the center (an axis of rotation) of control shaft 12. The intermediate portion of control shaft 12 is rotatably supported by means of a bearing housing 13. Bearing housing 13 is fixed to an engine cylinder block 2 by means of mounting bolts 14. As shown in FIG. 2, a wheel gear 15 is fixedly connected to the other end of control shaft 12 such that the axis of rotation of wheel gear 15 is coaxial with the axis of control shaft 12. Wheel gear 15 is in meshed-engagement with a worm gear 16 which is connected to an output shaft of an electric motor 17. That is, the motor 17, worm gear 16, wheel gear 15, bearing housing 13, control shaft 12, and eccentric pin 11 construct an actuator which provides rotary motion of control shaft 12 (that is, angular displacement of eccentric pin 11 about the axis of rotation of control shaft 12). That is, the actuator serves as a control mechanism that shifts the center of oscillating motion of rockable arm 8 to variably control a compression ratio. As can be seen in FIG. 1, lower connecting rod 7 consists of a half-split structure, namely two halves which are connected to each other by bolts 7*b* so that the halves rotatably encircle the crankpin journal portion. One half of lower connecting rod 7 has two circle bores for supporting the previously-noted connecting pins 6 and 9. The other half 7*a* of lower connecting rod 7 is cap-shaped and formed as a substantially semi-circular crankpin journal bearing portion. In FIG. 1, a portion denoted by reference sign 10*a* is a crankshaft main-bearing journal (simply, a main journal). Instead of the actuator using the eccentric pin 11 and control shaft 12 as shown in FIG. 2, another type of actuator shown in FIG. 3 may be used. In order to displace or move the center of oscillating motion of the other end 20 of rockable arm 8, the compression-ratio control actuator of FIG. 3 uses a crank-shaped shaft 18 and a crank-shaped control pin 19 whose axis is eccentric to the axis of rotation of crank-shaped shaft 18. In this case, the diameter of crank-shaped control pin 19 can be designed to be somewhat smaller than or equal to that of crank-shaped shaft 18, and as a result a ring-shaped end 20 of the rockable arm can be down-sized, while providing adequate mechanical strength and durability. In a similar manner as the lower connecting rod 7, the ring-shaped end 20 consists of a half-split structure, namely substantially semi-circular two halves which are connected to each other by bolts so that the halves rotatably encircle the journal portion of crank-shaped control pin 19.

In order to change the compression ratio, first, motor 17 is driven so as to cause rotary motion of control shaft 12 and change the angular position of control shaft 12 to a desired position based on engine operating conditions such as engine speed and engine load. The change in angular position of control shaft 12 causes a change in the center of oscillating motion of rockable arm 8 arranged eccentrically to the center (the axis of rotation) of control shaft 12. This results in a change in the position of top dead center (TDC) of the piston, thus varying the compression ratio.

Figures 4A, 4B, 4C:
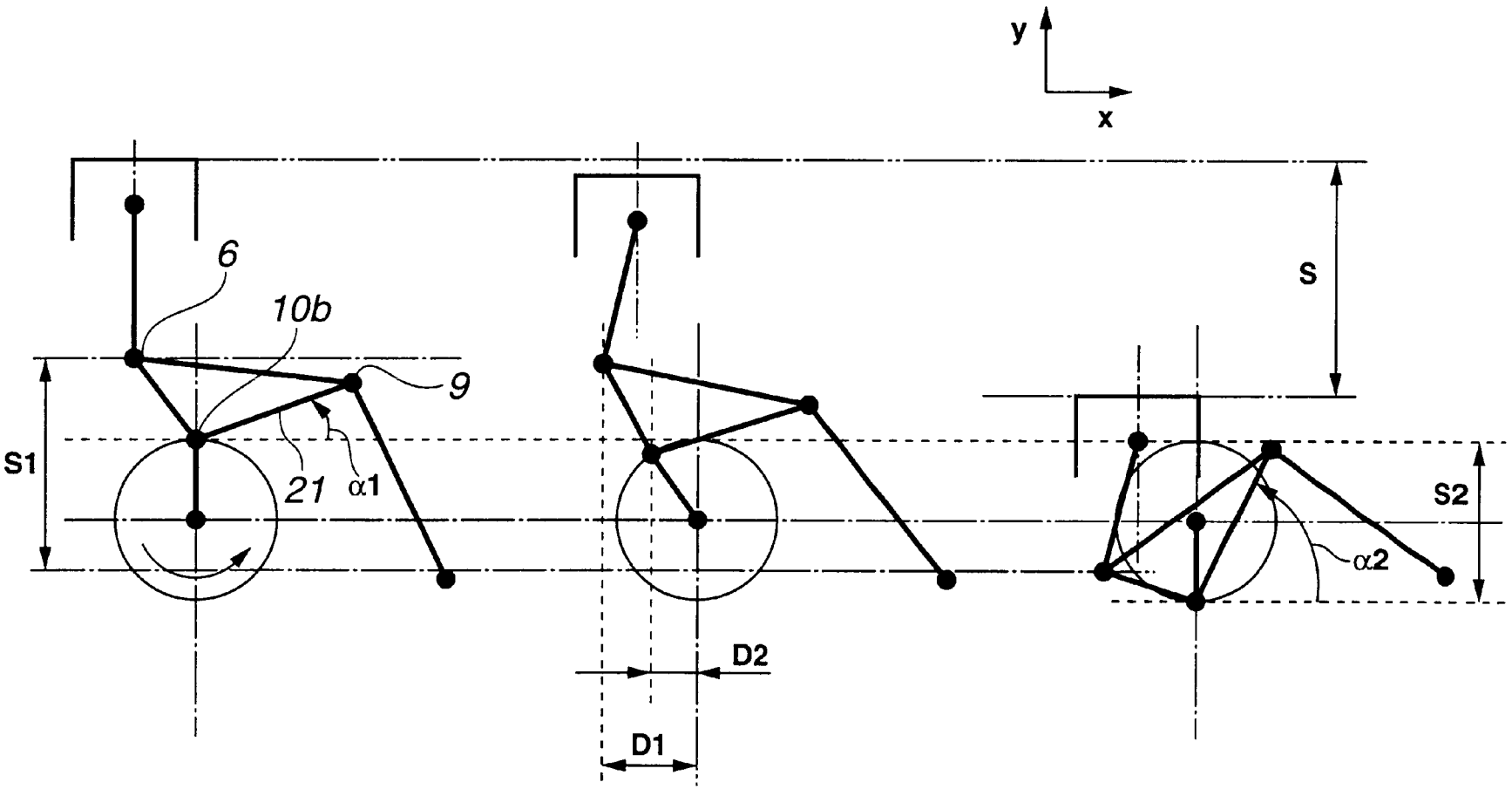
FIGS. 4A, 4B, and 4C show explanatory views of increased piston stroke, respectively at TDC, at an intermediate position between TDC and BDC, and at BDC, under a particular condition in which the compression ratio is fixed.

Necessary conditions needed for increased piston stroke are hereunder described in detail in reference to FIGS. 4A, 4B, and 4C. FIG. 4A shows a state of the mechanism of the embodiment at 0° crankangle (CA) which corresponds to top dead center (TDC). FIG. 4C shows a state of the mechanism of the embodiment at 180° CA which corresponds to bottom dead center (BDC). FIG. 4B shows a state of the mechanism of the embodiment conditioned in an intermediate position between TDC and BDC. On the assumption that a directed line parallel to the direction of piston stroke is taken as a y-axis, a directed line perpendicular to both the direction of piston stroke and the axis of rotation of crankshaft 10 is taken as an x-axis, the distance from the center of connecting pin 6 to the plane including the axis of rotation of crankshaft 10 and extending in the direction of the y-axis is denoted by D1, and the distance from the center of crankpin 10*b* to the plane including the axis of rotation of crankshaft 10 and extending in the direction of the y-axis is denoted by D2 (see FIG. 4B). With the piston held at TDC (see FIG. 4A), the angle between the x-axis and the straight line passing through or the line segment (link) 21 between and including the center of crankpin 10*b* and the center of connecting pin 9 (or the inclination angle of link 21 with respect to the direction of the X-axis) is denoted by $\alpha 1$. With the piston held at BDC (see FIG. 4C), the angle between the x-axis and the straight line passing through or the line segment 21 between and including the center of crankpin 10*b* and the center of connecting pin 9 (or the inclination angle of link 21 with respect to the direction of the X-axis) is denoted by $\alpha 2$.

In FIGS. 4A through 4C, S denotes an amount of piston stroke, S1 denotes a travel distance of connecting pin 6 in the direction of the y-axis, and S2 denotes a dimension corresponding to two times a crank radius of crankpin 10*b* swinging in a circle around the crankshaft. On the assumption as discussed above, (i) when the distance D1 from the center of connecting pin 6 to the plane including the axis of rotation of crankshaft 10 and extending in the direction of the y-axis is greater than or equal to the distance D2 from the center of crankpin 10*b* to the plane including the axis of rotation of crankshaft 10 and extending in the direction of the y-axis during the piston stroke from the upper limit of piston movement (that is, TDC) to the lower limit of piston movement (that is, BDC), and additionally (ii) when the angle $\alpha 1$ between the x-axis and the line segment 21 at TDC is less than or equal to the angle $\alpha 2$ between the x-axis and the line segment 21 at BDC, the travel distance S1 of connecting pin 6 becomes greater than the dimension S2 (two times the crank radius). That is to say, if the first necessary condition defined by $D1 \geqq D2$ between TDC and BDC and the second necessary condition defined by $\alpha 1 \leqq \alpha 2$ are simultaneously satisfied, in accordance with the principle of lever-and-fulcrum or leverage a desirable condition defined by an inequality $S1 > S2$ is satisfied. As can be appreciated from FIG. 4A, the piston stroke S substantially corresponds to the travel distance S1 of connecting pin 6 in the direction of the y-axis (that is, $S \approx S1$). Thus, an inequality $S > S2$ can be satisfied. As set out above, under the first and second necessary conditions (i) and (ii), it is possible to attain the more increased piston stroke. Therefore, as compared to a crank radius of a typical reciprocating internal combustion engine having a piston crank mechanism and having the same engine's displacement, the crank radius of the mechanism of the embodiment can be effectively reduced or shortened. This enables increased overlap between crankpin 10*b* and crankshaft main journal 10*a*, and thus enhances the rigidity and mechanical strength of the crank, and enables lightening of the crank. The mechanism of the embodiment is superior in reduced noise and vibrations.

Figure 5:
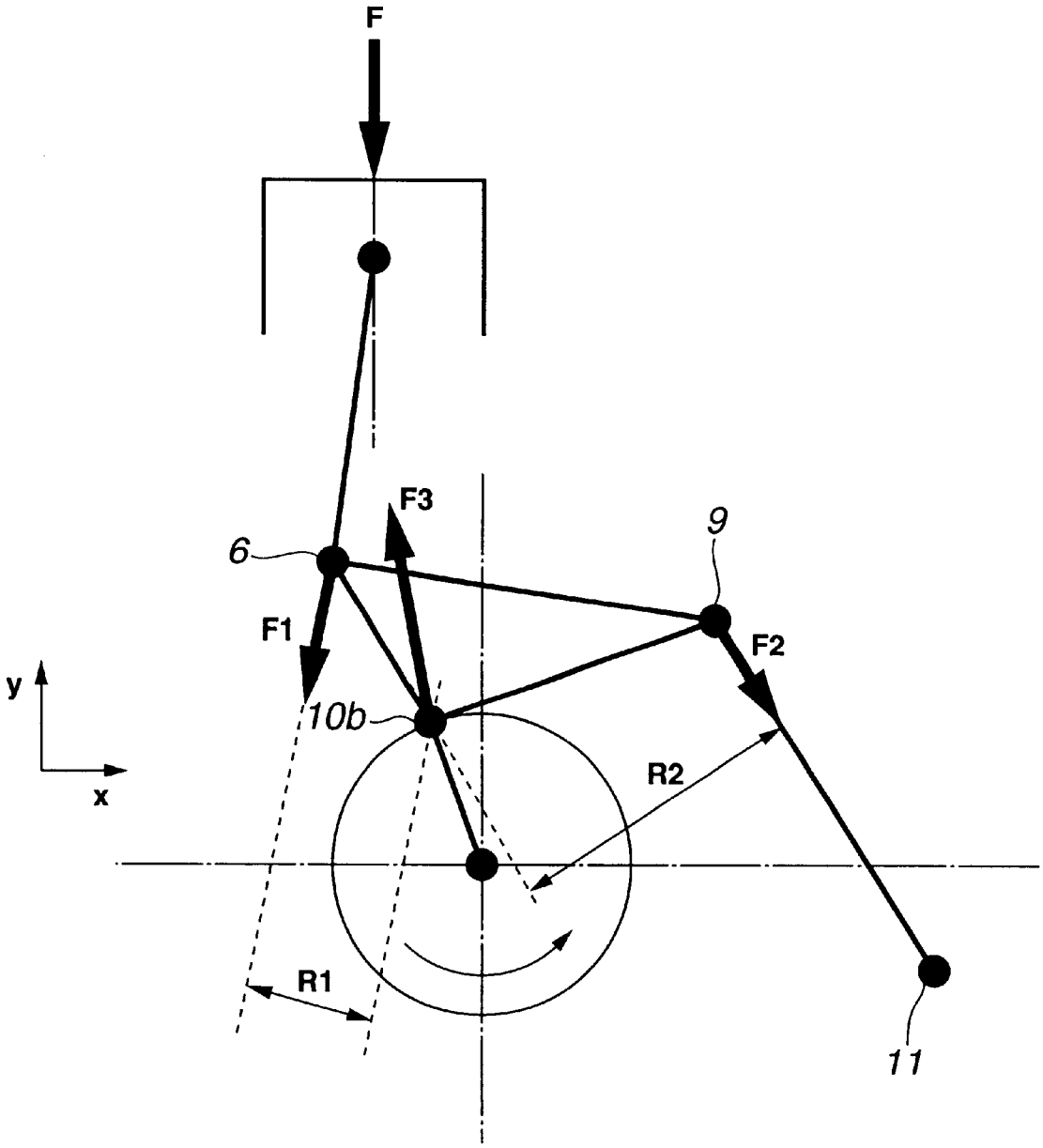
FIG. 5 is a diagram illustrating analytical mechanics for applied forces (F, F1, F2, F3) nearby top dead center (TDC).

On the major premise that the piston stroke is increased as previously described with reference to FIGS. 4A–4C, vector analysis or vector mechanics for the load or force acting on crankpin 10*b* will be hereinafter explained in reference to FIG. 5. FIG. 5 shows a state of the mechanism of the embodiment near TDC. As is well known, the load or force produced by combustion pressure is applied via the piston crown through the piston pin and upper connecting rod to connecting pin 6 at TDC on expansion stroke (see FIG. 4A). On the other hand, at TDC on exhaust stroke, an inertial force of reciprocating parts of the engine acts on connecting pin 6 via the piston pin and upper connecting rod. At the timing of application of combustion pressure (combustion load) or inertial force as shown in FIG. 5, F denotes the combustion load or inertial force applied through the piston head to the piston pin, F1 denotes a force transmitted through upper connecting rod 4 and acting on connecting pin 6, F2 denotes a force acting on the connecting pin 9, F3 denotes a force acting on crankpin 10*b*, R1 denotes an arm length, often called "arm", for a moment of the force F1 about crankpin 10*b*, and R2 denotes an arm length for a moment of the force F2 about crankpin 10*b*. The applied force F3 of crankpin 10*b* is hereinafter referred to as a "crankpin load". As viewed from equilibrium of forces or equilibrium of moments, assuming that the moments of the external forces (F1, F2) about crankpin 10*b* are balanced to each other, the following expression is satisfied.

$$F1 \times R1 = F2 \times R2 \quad \therefore \quad F2 = F1 \times R1/R2 \tag{1}$$

On the other hand, the crankpin load F3 is represented by the following equation. As a matter of course, the forces F1, F2, F3 are vector quantities.

$$F3 = F1 + F2$$

In the above equation, force F1 is dependent on the combustion load or inertial force of piston 3. Therefore, it is difficult to reduce force F1 for the purpose of reducing crankpin load F3. For reduced crankpin load F3, it is desirable to reduce the force F2. To achieve this, as appreciated from the expression (1), in the shown embodiment, the ratio R1/R2 of arm R1 to arm R2 is set to be less than 1, that is, $R1/R2 < 1$. For example, when $R1/R2 = 0.2$, the following relation is satisfied.

$$F3 = F1 + F2 = F1 + 0.2 \times F1 = 1.2 \times F1$$

As explained above, if the condition defined by $R1/R2 < 1$ is satisfied, it is possible to effectively suppress excessive crankpin load at or near TDC while ensuring increased piston stroke.

Figure 6:
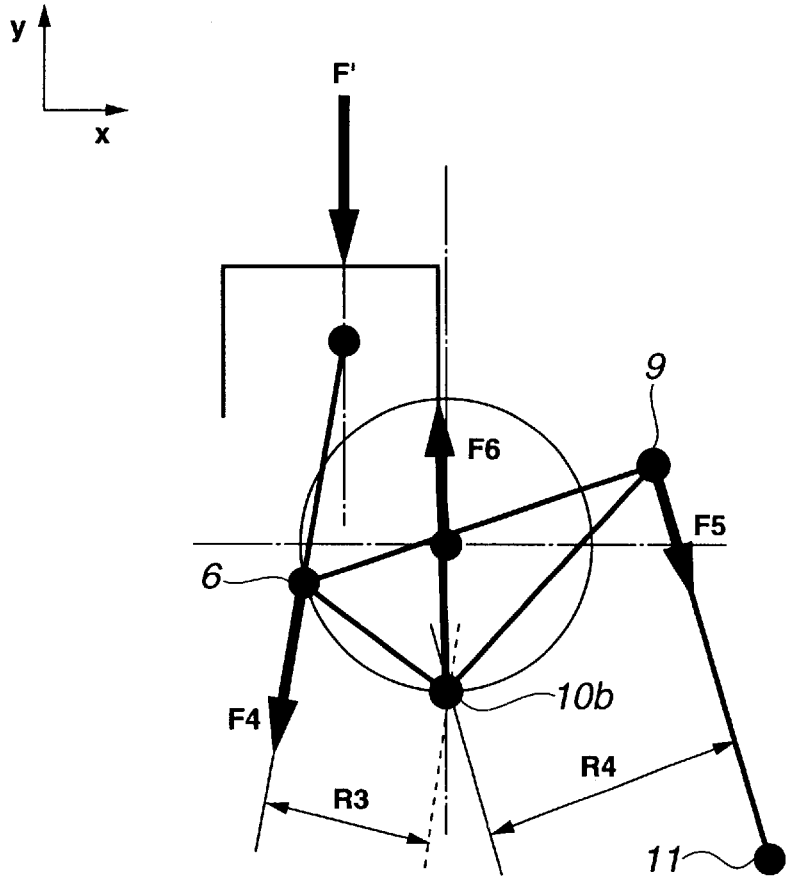
FIG. 6 is a diagram illustrating analytical mechanics for applied forces (F', F4, F5, F6) nearby bottom dead center (BDC).

FIG. 6 shows a timing at which an inertial force F' is applied to the piston crown near BDC. At this time, F4 denotes a force acting on and transmitted through upper connecting rod 4 and acting on connecting pin 6, F5 denotes a force acting on the connecting pin 9, F6 denotes a force acting on crankpin 10*b*, R3 denotes an arm length for a moment of the force F4 about crankpin 10*b*, and R4 denotes an arm length for a moment of the force F5 about crankpin 10*b*. As viewed from equilibrium of moments, assuming that the moments of the external forces (F4, F5) about crankpin 10*b* are balanced, the following expression is satisfied.

$$F4 \times R3 = F5 \times R4 \quad \therefore \quad F5 = F4 \times R3/R4 \tag{2}$$

On the other hand, the crankpin load F6 is represented by the following equation. The forces F4, F5, F6 are vector quantities.

$$F6 = F4 + F5$$

In the above equation, force F4 is dependent on the inertial force of piston 3. Therefore, it is difficult to reduce force F4 for the purpose of reducing crankpin load F6. For reduced crankpin load F6, it is desirable to reduce the force F5. To achieve this, as appreciated from the expression (2), in the shown embodiment, the ratio R3/R4 of arm R3 to arm R4 is set to be less than 1, that is, $R3/R4 < 1$. For example, when $R3/R4 = 0.2$, the following relation is satisfied.

$$F6 = F4 + F5 = F4 + 0.2 \times F4 = 1.2 \times F4$$

As explained above, if the condition defined by $R3/R4 < 1$ is satisfied, it is possible to effectively suppress excessive crankpin load at or near BDC while ensuring increased piston stroke.

As will be appreciated from the above, in the mechanism of the embodiment, the installation-position relationship between connecting pin 6 and crankpin 10*b*, and the angle ($\alpha 1$ at TDC, $\alpha 2$ at BDC) of the link 21 (line segment between and including the center of crankpin 10*b* and the center of connecting pin 9) are properly specified, and additionally the arm lengths (R1, R2 at TDC; R3, R4 at BDC) of moments of forces about crankpin 10*b* are properly specified. Thus, according to the variable compression ratio mechanism of the reciprocating engine of the embodiment, it is possible to reconcile both increased piston stroke and reduced crankpin load.

Figure 7:
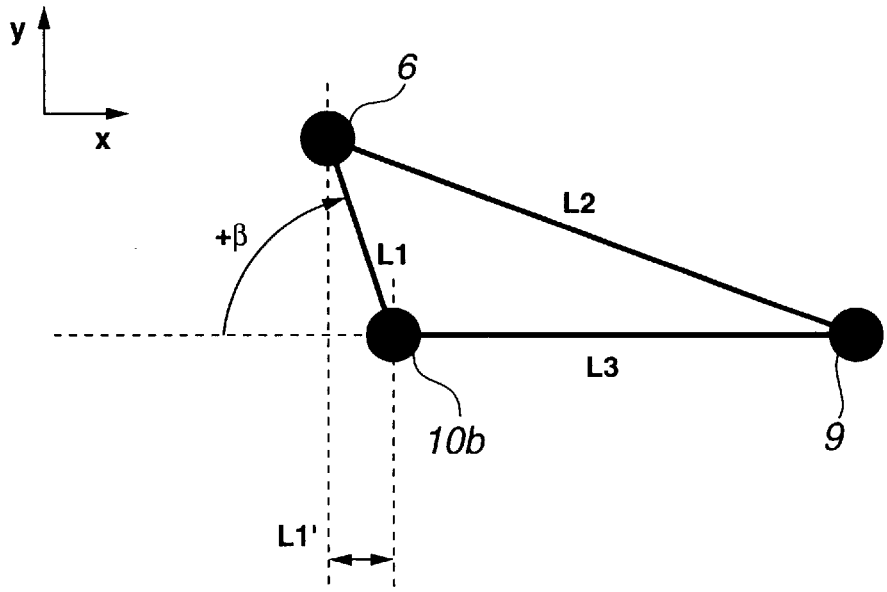
FIG. 7 is a simplified diagram illustrating dimensions and geometry of a lower connecting rod (A type).
Figure 8:
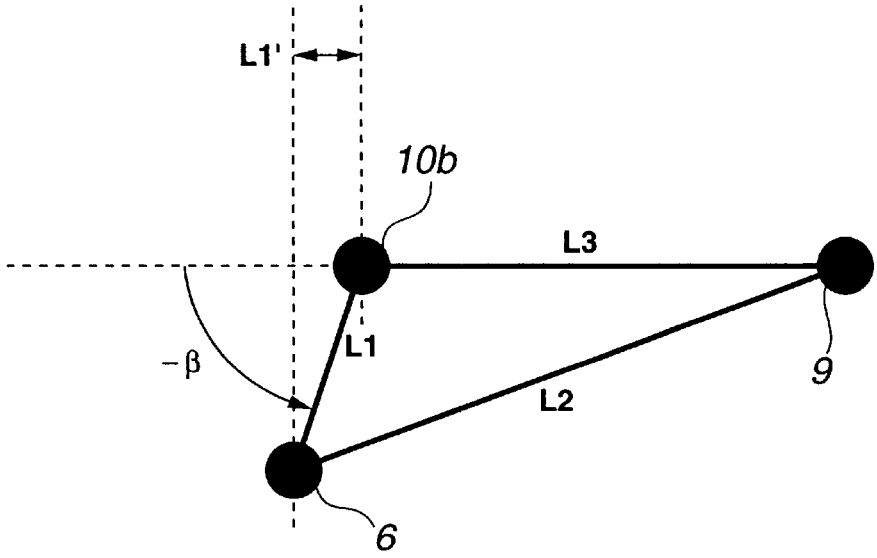
FIG. 8 is a simplified diagram illustrating dimensions and geometry of a lower connecting rod (B type).

The concrete shape and geometry of lower connecting rod 7 of the variable compression ratio mechanism of the embodiment, capable of providing the effects as previously discussed, is hereinafter described in detail in reference to FIGS. 7 and 8. In FIGS. 7 and 8, L1 denotes a distance between the center of crankpin 10*b* and the center of connecting pin 6, L2 denotes a distance between the center of connecting pin 6 and the center of connecting pin 9, and L3 denotes a distance between the center of crankpin 10*b* and the center of connecting pin 9. Lower connecting rod 7 is constructed or formed as a triangle consisting of the three sides L1, L2 and L3. In the variable compression ratio mechanism of the embodiment, the dimensional relationship among the sides L1, L2, and L3 is preset or predetermined to satisfy a predetermined inequality L1<L3≦L2. When considering the predetermined necessary condition defined by the inequality L1<L3≦L2, there are two types, namely an A type of lower connecting rod shown in FIG. 7 and a B type of lower connecting rod shown in FIG. 8. In the A type of lower connecting rod of FIG. 7, the center of connecting pin 6 is located above the straight line (x-axis) passing through both the center of crankpin 10*b* and the center of connecting pin 9, and the side L1 is inclined by an angle +β (in a positive sign indicates the clockwise direction in FIGS. 7 and 8) with respect to the straight line (x-axis) through the center of crankpin 10*b* and the center of connecting pin 9. In other words, connecting pin 6 is laid out within a space extending between the piston and the straight line passing through both the center of crankpin 10*b* and the center of connecting pin 9. In the B type of lower connecting rod of FIG. 8, the center of connecting pin 6 is located below the straight line (x-axis) through the center of crankpin 10*b* and the center of connecting pin 9, and the side L1 is inclined by an angle −β (a negative sign indicates the counterclockwise direction in FIGS. 7 and 8) with respect to the straight line (x-axis) through the center of crankpin 10*b* and the center of connecting pin 9. In other words, connecting pin 6 is laid out within a space below the straight line passing through both the center of crankpin 10*b* and the center of connecting pin 9 and thus the connecting pin 6 is arranged in the lower side opposite to the piston with respect to the straight line through both the center of crankpin 10*b* and the center of connecting pin 9. As clearly shown in FIGS. 7 and 8, by considering the necessary condition defined by the inequality L1<L3≦L2, at least under a particular condition in which the direction of rotation of the crank is the counterclockwise direction and additionally connecting pin 9 is laid out at the right-hand side of both connecting pin 6 and crankpin 10*b*, it is desirable that connecting pin 6 is located at the left-hand side of crankpin 10*b*, thereby ensuring increased piston stroke. Assuming that the distance from the center of connecting pin 6 to the plane including the center of crankpin 10*b* and extending in the direction of the y-axis is denoted by L1', arm length R1 of FIG. 5 and arm length R3 of FIG. 6 are in proportion to the distance L1' shown in FIGS. 7 and 8, while arm length R2 of FIG. 5 and arm length of FIG. 6 are in proportion to the length of side L3 of FIGS. 7 and 8. From the previously-discussed conditions needed for reduced crankpin load (F3; F6), that is, R1/R2<1 and R3/R4<1, and the aforementioned proportional relation, that is, R1 L1', R2 L3, and R3 L1', R4 L3, the following condition for reduced crankpin load can be derived.

$$R1\,L1',\ R2\,L3,\ R1/R2<1\ \therefore\ L1'/L3<1\ \text{(i.e., } L1'<L3\text{)}$$

$$R3\,L1',\ R4\,L3,\ R3/R4<1\ \therefore\ L1'/L3<1\ \text{(i.e., } L1'<L3\text{)}$$

That is, in case of L1'<L3, the crankpin load can be effectively reduced.

Figure 9:
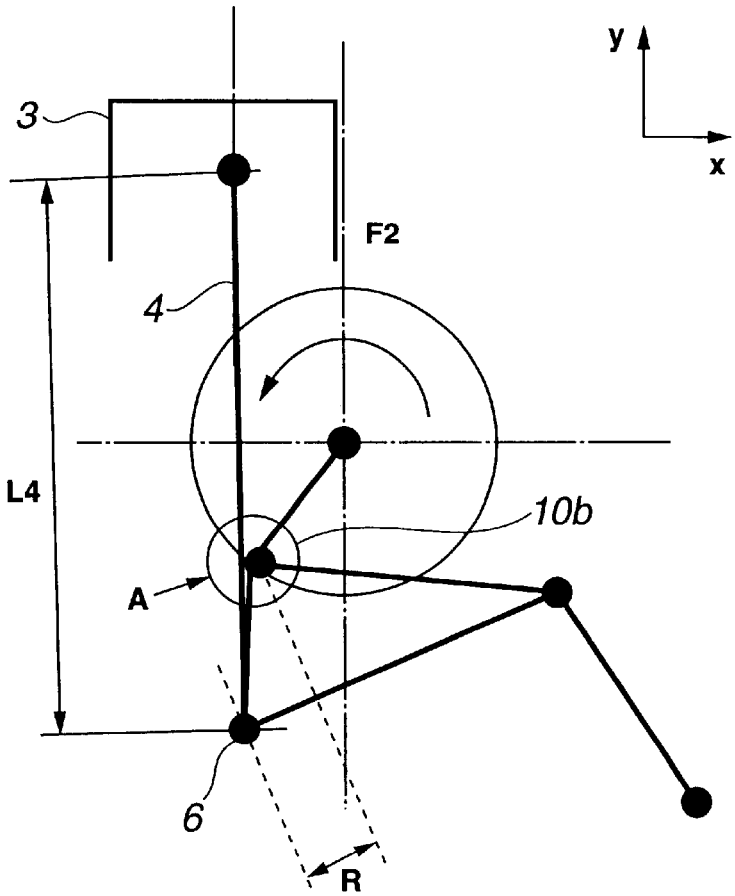
FIG. 9 is a simplified diagram showing an example of the variable compression ratio mechanism using the type B of the lower connecting rod.

FIG. 9 shows the simplified diagram of the variable compression ratio mechanism using the type B (see FIG. 8) of lower connecting rod 7. In the type B of lower connecting rod 7, if the arm length R for the moment of the force acting on connecting pin 6 about crankpin 10*b* is reduced in order to reduce the crankpin load, there is an increased tendency of the interference between crankpin 10*b* and upper connecting rod 4 at a portion indicated by a circle A in FIG. 9. In reducing the crankpin load by reducing the arm length R for the moment of the force acting on connecting pin 6 about crankpin 10*b*, the type B (FIG. 8) is inferior to the type A (FIG. 7) in the enhanced design flexibility (freedom of layout) and shortened upper connecting rod. As can be seen in FIG. 9, the connecting pin 6 is located at the underside of piston 3. Additionally, it is difficult to further lower the position of BDC of the piston, because of the interference between the piston and crankshaft counterweight. In comparison with the type A, the variable compression ratio mechanism using the type B requires the upper connecting rod of a relatively longer length L4. There is another problem, such as increased inertial force, reduced buckling strength, and the like. For the reasons set forth above, it is preferable to use the shape and geometry of the type A (FIG. 7) rather than the use of the type B (FIG. 8). In the shown embodiment, the type A of lower connecting rod is used.

Figure 10:
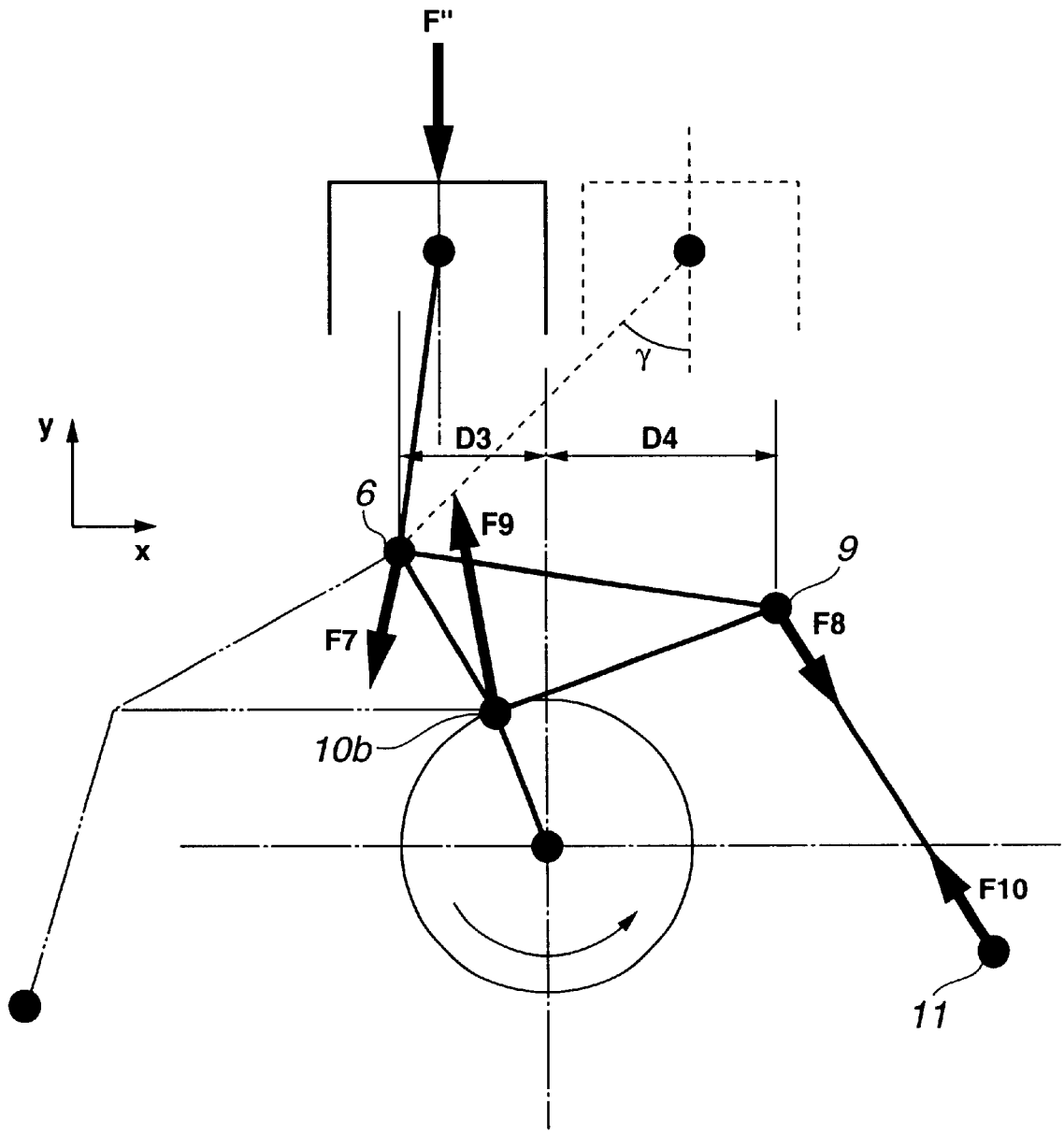
FIG. 10 is an explanatory view illustrating comparison between two different layouts of the piston and rockable arm near TDC.

Detailed analyses of a proper set position of piston 3 and a proper set position of the center of oscillating motion of the rockable arm 8 (serving as a control link) are hereinafter described in reference to FIG. 10. FIG. 10 shows the variable compression ratio mechanism using the type A of lower connecting rod 7 near TDC with two different layouts of the piston and rockable arm, one being indicated by the solid line and the other being indicated by the broken line (regarding the piston) and by the two-dotted line (regarding the center of oscillating motion of rockable arm 8). As discussed above (see FIGS. 5 and 6), in order to reduce a crankpin load F9 acting on crankpin 10*b*, it is necessary to shorten an arm length for a moment of the force F7 (acting on connecting pin 6) about crankpin 10*b* and to lengthen an arm length for a moment of the force F8 (acting on connecting pin 9) about crankpin 10*b*. In FIG. 10, F10 denotes a reaction force produced at the support (that is, eccentric pin 11) against the force F8 acting on connecting pin 9. That is, it is desirable to put the connecting pin 6 close to crankpin 10*b* and to keep the connecting pin 9 away from crankpin 10*b*. To achieve this, on the assumption that a directed line parallel to the direction of piston stroke is taken as a y-axis, a directed line perpendicular to both the direction of piston stroke and the axis of rotation of crankshaft 10 is taken as an x-axis, the distance from the center of connecting pin 6 to the plane including the axis of rotation of crankshaft 10 and extending in the direction of the y-axis is denoted by D3, and the distance from the center of connecting pin 9 to the plane including the axis of rotation of crankshaft 10 and extending in the direction of the y-axis is denoted by D4 (see FIG. 10), a condition defined by an inequality D3<D4 must be satisfied. In order to satisfy reduced thrust load (side thrust) acting on the thrust face of piston 3 and increased piston stroke in addition to the condition of D3<D4, assuming that the direction of rotation of the crank is the counterclockwise direction, the axis of rotation of crankshaft 10 is taken as an origin O, a directed line Ox is taken as an x-axis and a directed line Oy is taken as a y-axis, the piston-stroke axis must be laid out in the negative side of x-axis and connecting pin 9 must be laid out in the positive side of x-axis. In this case (owing to connecting pin 9 laid out in the positive side of x-axis), the center of oscillating motion of rockable arm (control link) 8, that is, the center of eccentric pin 11 is laid out in the positive side of x-axis. Conversely, if the piston is laid out in the positive side of x-axis (see the broken line shown in FIG. 10), an angle γ of oscillating motion of the upper connecting rod tends to be remarkably increased. As a matter of course, the increased angle γ of oscillating motion results in an increased side thrust. This undesiredly increases piston slapping noise and piston wear. Also, if the center of oscillating motion of rockable arm 8 (that is, the center of eccentric pin 11) is laid out in the negative side of x-axis, it is impossible to function as a variable piston-stroke mechanism (or a variable compression ratio mechanism). Therefore, as can be appreciated from FIGS. 1, 4A–4C, 5, 6, and 10, in the variable compression ratio mechanism of the embodiment, on the assumption that the direction of rotation of the crank is the counterclockwise direction, the axis of rotation of crankshaft 10 is taken as an origin O, a directed line Ox is taken as an x-axis and a directed line Oy is taken as a y-axis, the piston-stroke axis is laid out in the negative side of x-axis and connecting pin 9 is laid out in the positive side of x-axis. This layout also has the advantage of reducing a load applied to the fulcrum or support for oscillating motion of the rockable arm relatively to the crankpin load.

The entire contents of Japanese Patent Application No. P2000-135436 (filed May 9, 2000) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable compression ratio mechanism for a reciprocating internal combustion engine, comprising:

a connecting rod connecting a crank on a crankshaft with a piston, the connecting rod being split into an upper connecting rod portion oscillatingly linked to the piston through a piston pin and a lower connecting rod portion rotatably linked to a crankpin of the crankshaft;

the upper and lower connecting rod portions being oscillatingly linked to each other through a first connecting pin;

a rockable arm oscillatingly linked at one end to the lower connecting rod portion through a second connecting pin;

a control mechanism shifting a center of oscillating motion of the rockable arm to vary a compression ratio of the engine;

the rockable arm being oscillatingly linked at its other end via the control mechanism to a cylinder block;

a piston stroke of the piston being set to be greater than two times a crank radius of the crank on the crankshaft, irrespective of whether the compression ratio is varied by the control mechanism; and a linkage having at least the upper and lower connecting rod portions, the first and second connecting pins and the rockable arm being dimensioned and laid out, so that a crankpin load acting on the crankpin is less than a crankpin load produced by a linkage that has the crankpin located on a perpendicular line at substantially a midpoint of a line segment between and including a center of the first connecting pin and a center of the second connecting pin, wherein assuming that a directed line perpendicular to both a direction of the piston stroke and an axis of rotation of the crankshaft is taken as an x-axis, a directed line parallel to the direction of the piston stroke is taken as a y-axis, a distance from the center of the first connecting pin to a plane including the axis of rotation of the crankshaft and extending in a direction of the y-axis is denoted by D1, and a distance from a center of the crankpin to the plane including the axis of rotation of the crankshaft and extending in the direction of the y-axis is denoted by D2, at top dead center of the piston an inclination angle of a link containing a line segment between and including the center of the crankpin and the center of the second connecting pin with respect to a direction of the x-axis is denoted by α1, and at bottom dead center of the piston the inclination angle of the link containing the line segment between and including the center of the crankpin and the center of the second connecting pin with respect to the direction of the x-axis is denoted by α2, the distance D1 is set to be greater than or equal to the distance D2 during the piston stroke from the top dead center to the bottom dead center and additionally the inclination angle α1 is set to be less than or equal to the inclination angle α2, irrespective of whether the compression ratio is varied by the control mechanism.

2. The variable compression ratio mechanism as claimed in claim 1, wherein assuming that a directed line perpendicular to both a direction of the piston stroke and an axis of rotation of the crankshaft is taken as an x-axis, near top dead center of the piston a connecting point between the lower connecting rod portion and the crankpin is located between the first and second connecting pins as viewed in a direction of the x-axis, and assuming that near the top dead center an arm length for a moment of a force acting on the first connecting pin about the crankpin is denoted by R1 and an arm length for a moment of a force acting on the second connecting pin about the crankpin is denoted by R2, the arm length R1 is set to be less than the arm length R2, irrespective of whether the compression ratio is varied by the control mechanism.

3. The variable compression ratio mechanism as claimed in claim 1, wherein assuming that a directed line perpendicular to both a direction of the piston stroke and an axis of rotation of the crankshaft is taken as an x-axis, near bottom dead center of the piston a connecting point between the lower connecting rod portion and the crankpin is located between the first and second connecting pins as viewed in a direction of the x-axis, and assuming that near the bottom dead center an arm length for a moment of a force acting on the first connecting pin about the crankpin is denoted by R3 and an arm length for a moment of a force acting on the second connecting pin about the crankpin is denoted by R4, the arm length R3 is set to be less than the arm length R4, irrespective of whether the compression ratio is varied by the control mechanism.

4. The variable compression ratio mechanism as claimed in claim 1, wherein assuming that a distance between a center of the crankpin and the center of the first connecting pin is denoted by L1, a distance between the center of the first connecting pin and the center of the second connecting pin is denoted by L2, and a distance between the center of the crankpin and the center of the second connecting pin is denoted by L3, the lower connecting rod portion is constructed as a triangle consisting of three sides respectively corresponding to the distances L1, L2 and L3, and a dimensional relationship among the three sides of the distances L1, L2, and L3 is preset to satisfy a predetermined inequality $L1<L3\leqq L2$.

5. The variable compression ratio mechanism as claimed in claim 4, wherein the first connecting pin is laid out within a space extending between the piston and a straight line passing through both the center of the crankpin and the center of the second connecting pin.

6. The variable compression ratio mechanism as claimed in claim 5, wherein assuming that an axis of rotation of the crankshaft is taken as an origin, a directed line perpendicular to both a direction of the piston stroke and the axis of rotation of the crankshaft is taken as an x-axis, and a direction of rotation of the crank is a counterclockwise direction, the center of oscillating motion of the rockable arm is laid out in a positive side of the x-axis and an axis of the piston stroke is laid out in a negative side of the x-axis.

7. A variable compression ratio mechanism for a reciprocating internal combustion engine, comprising:

a connecting rod connecting a crank on a crankshaft with a piston, the connecting rod being split into an upper connecting rod portion oscillatingly linked to the piston through a piston pin and a lower connecting rod portion rotatably linked to a crankpin of the crankshaft;

the upper and lower connecting rod portions being oscillatingly linked to each other through a first connecting pin;

a rockable arm oscillatingly linked at one end to the lower connecting rod portion through a second connecting pin;

a compression-ratio control means for shifting a center of oscillating motion of the rockable arm to vary a compression ratio of the engine;

the rockable arm being oscillatingly linked at its other end via the compression-ratio control means to a cylinder block;

a piston stroke of the piston being set to be greater than two times a crank radius of the crank on the crankshaft, irrespective of whether the compression ratio is varied by the compression-ratio control means; and a linkage having at least the upper and lower connecting rod portions, the first and second connecting pins and the rockable arm being dimensioned and laid out, so that an arm length for a moment of a force acting on the first connecting pin about the crankpin is shortened relatively to an arm length for a moment of a force acting on the second connecting pin about the crankpin, wherein assuming that a directed line perpendicular to both a direction of the piston stroke and an axis of rotation of the crankshaft is taken as an x-axis, a directed line parallel to the direction of the piston stroke is taken as a y-axis, a distance from the center of the first connecting pin to a plane including the axis of rotation of the crankshaft and extending in a direction of the y-axis is denoted by D1, and a distance from a center of the crankpin to the plane including the axis of rotation of the crankshaft and extending in the direction of the y-axis is denoted by D2, at top dead center of the piston an angle between a line segment between and including the center of the crankpin and the center of the second connecting pin and the x-axis is denoted by $\alpha 1$, and at bottom dead center of the piston the angle between the line segment between and including the center of the crankpin and the center of the second connecting pin and the x-axis is denoted by $\alpha 2$, the distance D1 is set to be greater than or equal to the distance D2 during the piston stroke from the top dead center to the bottom dead center and additionally the angle $\alpha 1$ is set to be less than or equal to the angle $\alpha 2$, irrespective of whether the compression ratio is varied by the compression-ratio control means.

8. The variable compression ratio mechanism as claimed in claim 7, wherein assuming that an axis of rotation of the crankshaft is taken as an origin, a directed line perpendicular to both a direction of the piston stroke and the axis of rotation of the crankshaft is taken as an x-axis, and a directed line parallel to the direction of the piston stroke is taken as a y-axis, a distance from the center of the first connecting pin to a plane including the axis of rotation of the crankshaft and extending in a direction of the y-axis is denoted by D3, and a distance from the center of the second connecting pin to the plane including the axis of rotation of the crankshaft and extending in the direction of the y-axis is denoted by D4, the distance D3 is set to be less than the distance D4.

9. The variable compression ratio mechanism as claimed in claim 7, wherein assuming that a distance between a center of the crankpin and the center of the first connecting pin is denoted by L1, a distance between the center of the first connecting pin and the center of the second connecting pin is denoted by L2, and a distance between the center of the crankpin and the center of the second connecting pin is denoted by L3, the lower connecting rod portion is constructed as a triangle consisting of three sides respectively corresponding to the distances L1, L2 and L3, and a dimensional relationship among the three sides of the distances L1, L2, and L3 is preset to satisfy a predetermined inequality $L1<L3\leqq L2$.

10. The variable compression ratio mechanism as claimed in claim 9, wherein assuming that a direction of rotation of the crank is a counterclockwise direction and the second connecting pin is laid out at a right-hand side of both the first connecting pin and the crankpin, the side corresponding to the distance L1 is inclined clockwise by a predetermined positive angle with respect to a straight line passing through both the center of the crankpin and the center of the second connecting pin.

11. The variable compression ratio mechanism as claimed in claim 10, wherein assuming that an axis of rotation of the crankshaft is taken as an origin and a directed line perpendicular to both a direction of the piston stroke and the axis of rotation of the crankshaft is taken as an x-axis, the center of oscillating motion of the rockable arm is laid out in a positive side of the x-axis and an axis of the piston stroke is laid out in a negative side of the x-axis.

12. The variable compression ratio mechanism as claimed in claim 11, wherein the compression-ratio control means comprises at least an eccentric pin rockably supporting the end of the rockable arm to permit the oscillating motion of the rockable arm, a control shaft fixed to the eccentric pin so that a center of the eccentric pin is eccentric to an axis of rotation of the control shaft, and a bearing housing rotatably supporting the control shaft, said control shaft being rotatable to cause an angular displacement of the eccentric pin about the axis of rotation of the control shaft, based on engine operating conditions.

13. The variable compression ratio mechanism as claimed in claim 11, wherein the compression-ratio control means comprises at least a crank-shaped shaft and a crank-shaped control pin whose axis is eccentric to an axis of rotation of the crank-shaped shaft for rockably supporting the end of the rockable arm to permit the oscillating motion of the rockable arm, and a bearing housing rotatably supporting the crank-shaped shaft, said crank-shaped shaft being rotatable to cause an angular displacement of the crank-shaped pin about the axis of rotation of the crank-shaped shaft, based on engine operating conditions.

* * * * *